US005318202A

United States Patent [19]

D'Andrade

[11] Patent Number: 5,318,202

[45] Date of Patent: * Jun. 7, 1994

[54] ACTION FIGURE WITH REMOTE WATER SOURCE FOR SHOOTING WATER

[76] Inventor: Bruce M. D'Andrade, 3 Ten Eyck Rd., Whitehouse Station, N.J. 08889

[ * ] Notice: The portion of the term of this patent subsequent to Dec. 24, 2008 has been disclaimed.

[21] Appl. No.: 998,605

[22] Filed: Dec. 30, 1992

Related U.S. Application Data

[63] Continuation-in-part of Ser. No. 895,272, Jun. 8, 1992, which is a continuation-in-part of Ser. No. 841,762, Feb. 28, 1992, Pat. No. 5,150,819, and a continuation of Ser. No. 680,247, Apr. 3, 1991, abandoned, which is a continuation-in-part of Ser. No. 578,145, Sep. 6, 1990, Pat. No. 5,074,437.

[51] Int. Cl.[5] ..... B67D 5/00; B67D 83/00; A63H 3/18

[52] U.S. Cl. ..... 222/78; 222/401; 222/79; 446/268; 446/473

[58] Field of Search ..... 222/78, 79, 130, 325, 222/396, 400.7, 400.8, 401, 175, 505, 385; 42/54; 273/349; 124/70, 73; 239/333, 99; 446/473, 475, 267, 268, 296, 74

[56] References Cited

U.S. PATENT DOCUMENTS

| | | | |
|---|---|---|---|
| 2,589,977 | 3/1952 | Stelzer | 222/401 X |
| 3,578,789 | 5/1971 | Ferri | 222/79 |
| 4,214,674 | 7/1980 | Jones et al. | 222/175 X |
| 5,071,387 | 12/1991 | Pottick | 222/78 X |
| 5,074,437 | 12/1991 | D'Andrade et al. | 222/400.8 X |
| 5,150,819 | 9/1992 | Johnson et al. | 222/79 |
| 5,167,554 | 12/1992 | Tager et al. | 222/79 X |

*Primary Examiner*—Gregory L. Huson
*Attorney, Agent, or Firm*—Kenneth P. Glynn

[57] ABSTRACT

The present invention is an action figure with the ability to shoot water by means of an air pressurized water chamber. The action figure includes a body which is at least partially hollow and at least one body orifice. A water storage reservoir is connected to the body and it has a separate, remote water source for adding water thereto. The water storage reservoir is connected to a pumping and pressurizing means which in turn is connected to the remote water source. The pumping and pressurizing means for pumping the reservoir water and to pressurize the air therein after the water has been added There is an avenue of release which runs from the reservoir to a nozzle and a water release means for regulating the fluid flow through the avenue of release. The water release means is operably connected to the avenue of release and extends outwardly therefrom to permit manual operation. A nozzle at the end of the avenue of release controllably releases water when the water release means is actuated.

20 Claims, 5 Drawing Sheets

ACTION FIGURE WITH REMOTE WATER SOURCE FOR SHOOTING WATER

REFERENCE TO RELATED CASES

This application is a continuation-in-part of copending U.S. Patent application Ser. No. 07/895,272, files on Jun. 8, 1992, by Bruce D'Andrade, for "Action Figure with the Ability to Shoot Water", which is a Continuation-In-Part of U.S. Patent application Ser. No. 07/841,762, filed on Feb. 28, 1992, by Bruce M. D'Andrade and Lonnie Johnson, for "Double Tank Pinch Trigger Pump Water Gun", now U.S. Pat. No. 5,150,819 and is a File Wrapper Continuation of U.S. Patent application Ser. No. 07/680,247, filed on Apr. 3, 1991, now abandoned, having the same inventors and title, which is a continuation-in-part of previously copending U.S. Patent application Ser. No. 07/578,145, filed on Sep. 6, 1990, having the same inventors, for "Pinch Trigger Pump Water Gun", now U.S. Pat. No. 5,074,437, issued on Dec. 24, 1991. The subject matter contained in the above referenced cases common to this application and embodied in the claimed subject matter herein, is the invention of Bruce M. D'Andrade, the inventor herein.

BACKGROUND OF THE INVENTION

1. Field of the Invention

The present invention is directed to an action figure with the ability to shoot water by means of an air pressurized water chamber and a separate, remote water source. More specifically, it relates to an action figure having movable extremities and having a separate water source, pressurized chamber and separate pumping and pressurizing mechanism and releasing mechanism for drawings, pressuring and shooting liquid therefrom.

2. Information Disclosure Statement

Many toys and similar products have been developed over the years which pertain to dispensing water. Some have been to combine function with entertainment for children, e.g. shampoo dispensing, others have been to mimic or recreate bodily functions, e.g. crying, urinating, etc., while others have been for pure entertainment, e.g. water spraying with figures or dolls.

The following patents represent a chronological history of such diverse prior art:

U.S. Pat. No. 928,059, describes a soap dispenser having a force pump with animated features. The force pump is immersed in liquid, e.g. soap and the pump stroke causes direct dispensing.

U.S. Pat. No. 1,266,106 describes a toy whale with wind up, spring loaded wheels which move a reciprocating plunger which causes pushing force on a flexible reservoir. When this is filled with water and the whale is moving, the plunger causes the whale to "blow" water.

U.S. Pat. No. 1,893,972 shows a novelty gasoline pump with an elephant encasement, the trunk of which is the pump hose. The hose is extendable and automatically retractable through the elephant's trunk.

U.S. Pat. No. 3,388,835 describes a dispenser for lotion or bubble bath. The device has a container of toy-like character, a dispensing mechanism including a plunger tube attached to one end of a suction cylinder. The plunger tube extends downwardly into the liquid contained within the container, the plunger tube being attached at the lower end of the suction cylinder. A sidewardly extending flexible tube out of which the liquid is dispensed, is included, and an upper plunger tube is connected to the upper end of the suction cylinder, the upper plunger tube having a press-button at its upper end.

U.S. Pat. No. 3,420,412 sets forth a spraying device enclosure. It has an attractive hollow body simulating an animal in shape and of soft and flexible material to enclose a pressurized spray can. The body has an adjustable opening on the bottom for introduction of the can and opposing openings at the top, one of the openings permitting projection of the mouth of the spray can such as the bill of an animal, and the other opening permitting the introduction of the user's finger for operation of the plunger of the spray can.

U.S. Pat. No. 3,769,745 shows a toy doll which will produce tearing and simultaneously move its arms (in response thereto) to provide the appearance of a crying doll. A fluid reservoir, located in the head of the doll includes ducting to carry the fluid from that reservoir to the eyes of the doll. The eyes of the doll are arranged with respect to the ducting so as to deflect the fluid passing therethrough to create the appearance of a crying or tearing doll. An elastically compressible bulb, connected to the fluid reservoir, is located in the passageway between the head and the body of the doll and is aligned along the axis of rotation of the head. When the bulb is compressed, the fluid contained therein is displaced and passes from the fluid reservoir to the eyes of the doll. The tearing system has no overflow or air intake ports inside the doll.

U.S. Pat. No. 3,775,901 describes a child's doll with an internal reservoir into which a liquid may be introduced through the mouth orifice of the doll. The reservoir is also provided with a discharge valve whose opening is effected by the close proximity of a permanent magnet; such a magnet being provided attached to a training seat with chamber-pot. The doll is provided with an orifice at its lower extremity through which it can eliminate fluid when placed on the training seat.

U.S. Pat. No. 3,789,539 is directed to a weeping doll, having a head with eye sockets and an open mouth formed therein, is provided with a gravity influenced weeping device for causing the doll to weep when placed in a generally horizontal position. The weeping device includes a liquid inlet tube located adjacent the open mouth and a flexible reservoir tank in liquid communication with the inlet tube. A selectively operable valve is located in the inlet tube for opening the inlet to permit liquid to flow through the mouth to the reservoir. The inlet tube is provided by a rigid housing which defines a liquid flow conduit between the flexible reservoir and the eye sockets of the doll and means is provided for compressing the flexible reservoir when the doll is in a generally horizontal position to force liquid from the reservoir through the conduit to the eye sockets, in order to simulate weeping or tearing.

U.S. Pat. No. 3,855,729 describes a tearing reservoir which is pressurized by inflatable sack connected to a bellows mounted in figure toy head and receiving air from waterimpervious, hollow torso in fluid communication with bellows through a neck plug connected to the bellows and the torso in such a manner that water entering head when figure toy is immersed will not pass into torso. A reed-type noise maker may be mounted in the neck plug.

U.S. Pat. No. 4,193,517 is directed to a large capacity water squirting implement in the form of a cane. This water squirting implement utilizes a reciprocal plunger hand pump which is mounted at the top of a hollow, elongated tube which provides the large water storage capacity. A head is slidably secured to the top of the cane, enclosing the pump in such a way that reciprocal motion of the head is transmitted to the plunger of the pump to cause squirts of water to be emitted from a tube extending from the outlet of the pump to the exterior of the head.

U.S. Pat. No. 4,578,045 covers an action figure such as a human. The action figure includes two arms mounted to the figure's torso for rocking movement toward the torso about laterally spaced axes, the action figure also including two legs that are mounted for pivotal movement to the torso in a scissors-like fashion. Integral with the rockable mounting means for each arm is an inwardly extending shank, the shanks projecting into end portions of a coil spring. When either arm is moved laterally toward the side of the torso, the spring is flexed into a V-shaped configuration. A link extends downwardly from the center of the spring so that the flexing action imparted to the spring causes the link to move downwardly or upwardly. Each unit for pivotally mounting the legs includes a crank pin that is receivable in forwardly and rearwardly located slots at the lower end of the link. The arms can be independently swung from a position adjacent the sides of the figure to overhead or outstretched positions without affecting their ability to oscillate the legs in a scissors-like manner and thereby simulate running, swimming and kicking movements.

U.S. Pat. No. 4,601,672 is directed to toy actions figures which include upper and lower hollow torso portions. An actuating mechanism is contained in the upper torso and acts through a helical gear mechanism to rotate the lower torso portion and the legs attached thereto about a longitudinal axis when one of figure's arms is swung from a diverging relation toward one side of the figure. A spring is used to return the actuating mechanism and the limbs associated therewith back to their normal or unactuated positions. Another spring releases or disconnects the lower torso portion from the actuating mechanism should the child attempt to twist the two torso portions relative to each other by using too much force.

U.S. Pat. No. 4,623,319 covers an activity toy with a body including a hollow cylindrical portions supported on a base and having pivotally mounted arms has a hollow upper member including a skull with extrusion openings. The bottom of the upper member has a loading opening for a plastic amorphous solid substance. Attachable about and spaced from the skull is a clear plastic mask formed of separable halves clamped together at the bottom by the engagement of hooks and tabs and at the top by a detachable hairpiece. Near the bottom, the mask is maintained in a relatively tight relation to a flange on the hollow upper member. The upper member with the mask attached is secured to the body by a bayonet lock. Within the body is a piston with diametrically opposed gear racks that are engaged by gear segments on arms pivotally mounted to the body. Movement of the arms from an upraised position down to a lower position drives the piston into the hollow member through the loading opening to extrude the plastic amorphous substance out of the extrusion openings in the skull and fill the clear plastic mask.

U.S. Pat. No. 4,630,756 covers a liquid squirting simulated creature comprised of a front section having a body, legs and head, and a rear section which is assembled thereto. The front section is comprised of top and bottom elements defining a cavity therebetween and front and rear apertures, as well as apertures extending along the sides thereof through which a multiplicity of legs extend. The rear section is a resiliently compressible bulbous member providing a chamber therewithin to contain fluid and having a neck portion extending through the aperture in the rear wall of the front section. A tubular conduit is seated in an opening in the neck portion of the rear section and extends to a front aperture in the front section so as to provide the conduit for discharge of fluid from the chamber therethrough. The leg members are comprised of a web on each side interconnecting a multiplicity of legs on that side of the front section, and flexible portions which extend through apertures along the sides of the front section.

U.S. Pat. No. 4,723,931 describes various patterns of receptor holes formed in the torso, arms and legs of a plastic toy action figure to permit various accessories, also of plastic, having compliant press-in pins to be selectively added to and removed from the toy figure. Additionally, a rotatable coupling mechanism extends through the torso, the coupling mechanism having a receptor hole at each end thereof, the holes in the coupling mechanism being in a predetermined relation with respect to prearranged patterns of receptor holes in the front and rear of the torso. In this way, accessories can be plugged into the ends of the coupling mechanism. The coupling mechanism is provided with two sets of facial teeth or serrations that are normally resiliently urged into engagement but which disengage if the coupling mechanism is subjected to an excessive amount of twisting force, thereby avoiding breakage. Associated with the coupling mechanism is a sound creating device that produces an audible clicking as the coupling mechanism is rotated in either direction.

U.S. Pat. No. 4,768,681 describes a water action toy which is worn on a child's hand by means of a glove secured to and underneath a housing in which a water reservoir, a water pump, an electrical motor and a battery pack are housed. A pair of actuators are mounted on a thumb sheath and a forefinger sheath of the glove. When the actuators are brought together by finger manipulation, the motor drives the pump to eject water in a series of spurts from the toy.

U.S. Pat. No. 4,982,874 sets forth a shampoo dispensing container in the shape of an action figure, such as an army figure, and has a fluid pumping system that operates to dispense shampoo from the container in an exploding type pattern as one of the arms of the action figure is operated in a combat type movement.

U.S. Pat. No. 5,071,387 describes a figurine-shaped toy that squirts water out of its mouth by cranking an arm.

U.S. Pat. No. 5,083,965 covers an interactive doll system incorporates both liquid handling elements for receiving liquid through the mouth of the doll when the doll is in a first range of positions, then dispensing that liquid through the eyes of the doll when the doll is in a second range of positions or through an anal opening of the doll when the doll is in a third range of positions. It also incorporates an electronic assembly for sensing the attitude and motion of the doll, as well as feeding of the doll, and for producing a range of sounds in response thereto, including sounds produced randomly at times in response to motion of the doll.

U.S. Pat. No. 5,073,140 discloses toy action figures and detachable accessories therefore incorporating audio generating apparatus. The audio generating apparatus is entirely contained within the accessory and generates both speed and sound effects. The detachable accessories have a configuration and visual appearance coordinated with the configuration and visual appearance of the toy action figure. For example, the accessory may be a backpack configured and having a visual appearance to coordinate with a soldier, spaceman or policeman action figure. The audio generating apparatus includes separate controls for causing the audio generating apparatus to independently generate speech and sound effects. The accessories in configuration, appearance and sound content are made to be attachable and applicable to different types of action figures.

U.S. Pat. No. 4,239,129 to Gary F. Esposito describes a water pistol and/or flashlight structure which includes a reciprocal pump within a liquid chamber or tank located itself within the gun housing. The pump is used to pressurize air within the tank after the water has been added, and a trigger is used for subsequent release of the water. Battery operated lights and sound are also provided.

U.S. Pat. No. 3,578,789, issued to Giampiero Ferri, describes a water pistol which includes a main liquid reservoir and a pressurized liquid reservoir contained within the main liquid reservoir. The trigger-actuated pump is used with a manually operated three way valve to selectively supply liquid: (a) from the pump to the pressurized reservoir; (b) from the pump to the nozzle and to the pressurized liquid reservoir; or, (c) from the pressurized liquid reservoir.

Notwithstanding the plethora of prior art, none teaches or renders obvious the present invention.

SUMMARY OF THE INVENTION

The present invention is an action figure with the ability to shoot water by means of an air pressurized water chamber. The action figure includes a body which is at least partially hollow and has at least one body orifice. A water storage reservoir is connected to the body and it has a separate, remote water source for adding water thereto. The water storage reservoir is connected to a pumping and pressurizing means which in turn is connected to the remote water source. The pumping and pressurizing means is for pumping the reservoir water and to pressurize the air therein during and after the water has been added. There is an avenue of release which runs from the reservoir to a nozzle and a water release means for regulating the fluid flow through the avenue of release. The water release means is operably connected to the avenue of release and extends outwardly therefrom to permit manual operation. A nozzle at the end of the avenue of release controllably releases water when the water release means is actuated. The action figure may be a mammal or other character, with the pumping and pressurizing means being embodied partially in an appendage and the nozzle being located in an appendage. The water storage reservoir may be within the body of the action figure, or externally located and connected thereto. If external, it may be detachable or non-detachable.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE PRESENT INVENTION

Figure 1:
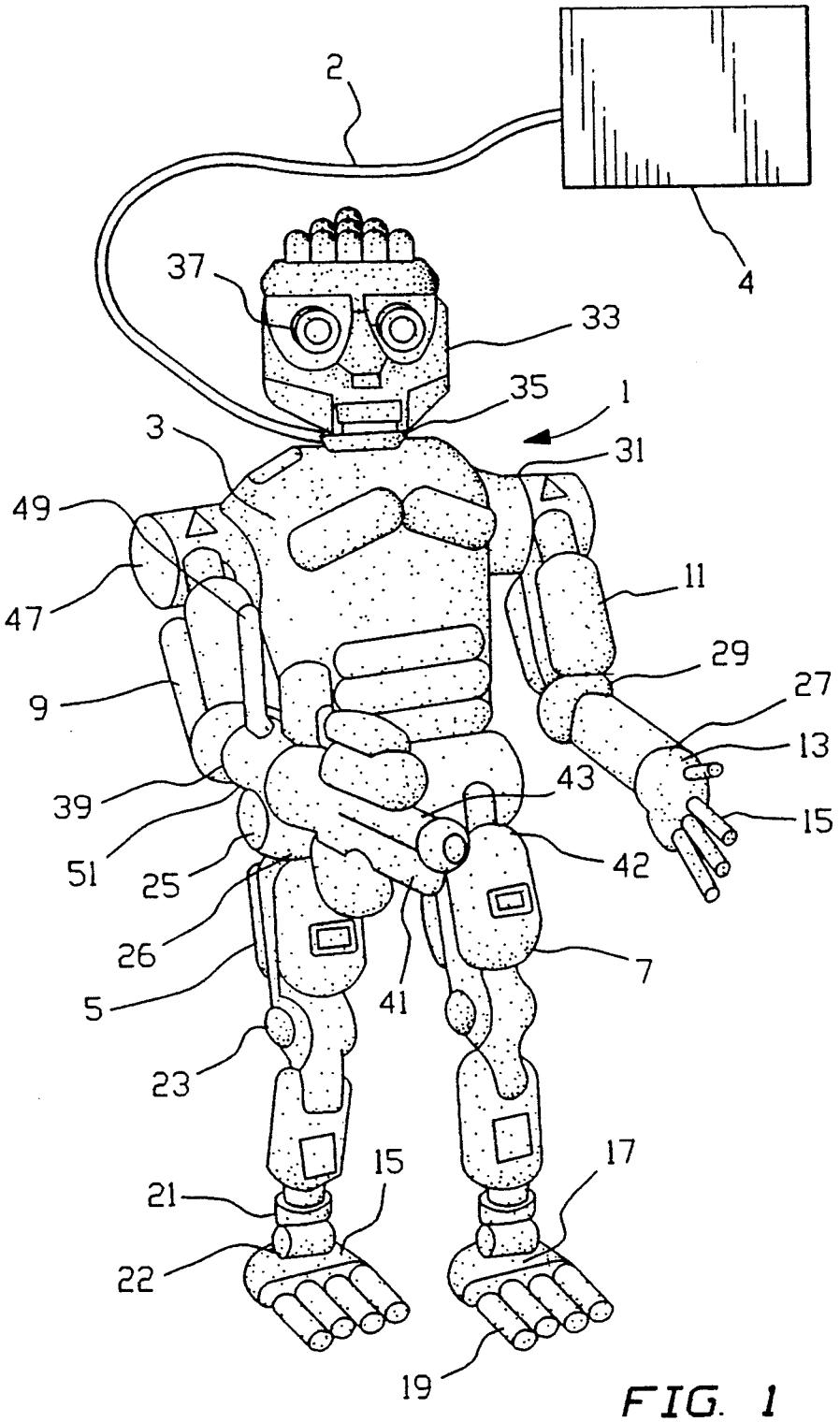
FIG. 1 shows an objective front view of one preferred embodiment action figure of the present invention.

The present invention is, as mentioned, directed toward a toy action figure with a water storage reservoir, with the ability to shoot streams of water. It has a remote water source and a pumping and pressurizing mechanism that pumps water from the remote source to the reservoir and that uses air to pressurize the water reservoir and to subsequently propel the water through a narrow nozzle as desired. Pressurized water toys are not new; they have been in existence for decades. Water pressure has been used in the toy industry for everything from launching toy rockets to propelling toy cars. Pressurized water toys come in two primary types. First there are water toys that use mechanical means to directly compress and pressurize water. Such toys represent a majority of the water toys manufactured today, and are exemplified by traditional water guns that use a trigger operated pump or a battery powered motor to squirt small amounts of water. The problem with toys that directly pump water is that to reach the required pressure for a satisfactory squirt, a small diameter piston is required. This in turn limits the amount of water that can be squirted in each shot. In addition, the speed at which the pump is activated, whether manually or by motor, affects the distance of the shot, and it requires many cycles to project any significant amount of water.

To solve these problems, toy manufacturers have turned to the technology of compressed air to pressurize a reservoir of water. Air is easily compressed to high pressures and this high pressure can be transferred to stored water. This technology is easily adapted to a child's strength and allows a relatively large amount of water to be pressurized at one time. This relatively large reserve of pressurized water allows a water gun to fire a large continuous stream of water at one time or multiple single streams of water sequentially without the need for repeated pumping cycles.

The problem with air pressurized toys is one of safety. Toys are designed to be inexpensive so as to be widely marketable. As such, most toys are made of plastics or other inexpensive materials. Such materials do not have large tensile strengths or fatigue characteristics, and therefore do not lend themselves well to containing pressurized fluids. Plastic containers for pressurized liquids, if not properly designed, can rupture and explode causing severe injury.

The present invention has a unique design that allows for both the use of high pressure air and the elimination of potential rupturing hazards. The present invention has a cylindrical water reservoir which is encompassed within a main section or body of an action figure, and formed of essential thickness and shape to maximize capacity and safety. The water storage reservoir utilized preferably has rounded cylinder ends which serve to maintain the integrity of the water reservoir walls and minimize the leak points throughout the material of the water reservoir, thereby allowing for the safe use of higher pressures. A single orifice connection from the water storage reservoir to the body of the action figure or within the body of the action figure was designed so that both the pressurized air from the air pump and the exiting pressurized water utilize the same opening without backflow problems to either. The present invention action figure has both character features and water gun features and is operated by pumping in the reservoir water from the remote water source to the reservoir, pumping up the pressure and selectively releasing the pressurized water through a narrow nozzle.

The selective release of the pressurized water is controlled by a water release means which is separate from the pump mechanism. Since the present invention has the ability to operate at high pressures, the water release mechanism performs two functions. First it controls the amount of water released and, second, it serves as a safety valve. The water release means of the present invention has an extension that pinches the exit hosing of the pressurized water. The pinching force is created by a spring. When the water release means is pressed, the spring bias of the pinching member is overcome and water is released. Similarly, when the pressure in the water reservoir reaches beyond safety limitations, the force of the compressed water will overcome the spring bias of the pinching member allowing water to be released until the pressure within the reservoir reaches a safe level.

The present invention is thus directed toward a toy action figure which is operated by selectively releasing water from a water reservoir that is pressurized with air. The water pressurizing means, e.g. an air pump, pumps water from a remote water source and pressurizes a water reservoir for subsequent squirting.

The pressurized water has an avenue of release that is regulated by the water release means of the invention. When no force is applied to the water release means, the pressurized water is held at bay with no means of release. When force is applied to it, water is released from the pressurized reservoir and is channeled through the avenue of release and then through a narrow nozzle. The escape of the pressurized water through the narrow nozzle creates a stream of propelled water that lasts as long as the water release means is engaged or until the pressure on the water in the reservoir equals the ambient air pressure.

Water is added to the present invention via at least one remote water source which is connected to the reservoir, e.g. via the pumping means. The reservoir itself is non-detachable from the action figure when it is contained therein and in some embodiments where it is external to the action figure. Other embodiments include removable reservoirs. However, the remote water source may be natural or man-made, may be a pool or river or pond, a swimming pool, a small portable tank, e.g. attachable to a belt of a user, or may be one or more tanks within a vehicle, e.g. a car, boat or otherwise, and the figure may be removably placed on or in it. Further, the remote water source and/or its connector, e.g. tubing, may be detachable.

There is an orifice on the reservoir on those embodiments where the reservoir is in the action figure and it is connected to the body of the action figure and serves as both the entrance point for installation of the pumping and pressurizing mechanism, and the exit point of the pressurized water. The water reservoir is formed apart from the body of the action figure so that the integrity of the reservoir's walls remains intact, allowing the water reservoir to hold high pressures without fear of rupture. Additionally, the danger of rupture is eliminated by the water release means, which, as mentioned, automatically and safely discharges pressurized water when over pressurized, but does not release the water automatically until the maximum allowable pressure is reached.

Referring now to FIG. 1 there is shown an oblique frontal view of an action figure of a robotic characteristic which is one preferred embodiment of the present invention. Shown in this FIG. 1 is the general action FIG. 1, having a main body 3, legs 5 and 7, and arms 9 and 11. There is a left hand 13, with appendages represented by finger 15. Legs 5 and 7 have feet 15 and 17, as shown. Elongated appendages such as toe 19, are included. Right foot 15 exemplifies the motion capabilities a hinged vertical motion is achieved with hinge 22 and rotational movement by member 21.

The legs 5 and 7 are also hingeable at the knees such as socket 23, shown. Likewise, hip motion is achieved by socket and collar such as sockets 25 and collar 26. Arm movements are likewise varied and compound. For example, left arm 11 has wrist rotation at member 27, forearm movement at member 29 and socket and collar movement at shoulder 31. Head 33 includes eyes 37 and other features shown and unscrewable neck 35.

Head 33 is freely rotatable and pumpable within neck 35 and this is discussed in conjunction with FIG. 5 below. Attached to collar 123 (FIG. 2 below) is connection tubing 2 which is connected also to remote water source 4. Tubing 2 is connected via plastic conduit to a pumping and pressuring mechanism also described below.

The right arm 9 of action FIG. 1 has rotation movement at member 39 and shoulder 47. Simulated weapon 41 includes an ejection nozzle 42, barrel 43, water release means 49 and attachment-detachment mechanism 51. These are discussed in more detail below.

Figure 2:
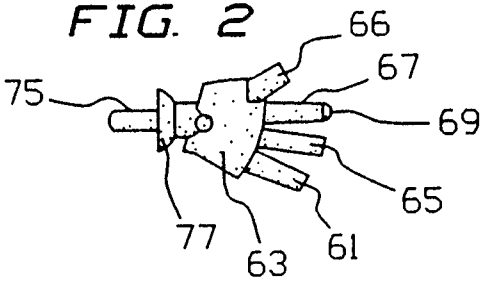
FIG. 2 shows the side view of a hand which may replace a weapon shown on one appendage of the action figure preferred embodiment expressed in FIG. 1.

FIG. 2 shows a hand 63 with attachment mechanism (snap on) 77 and extended tubing portion 75. Fingers 61, 65 and 67 and thumb 66 are included.

Figure 3:
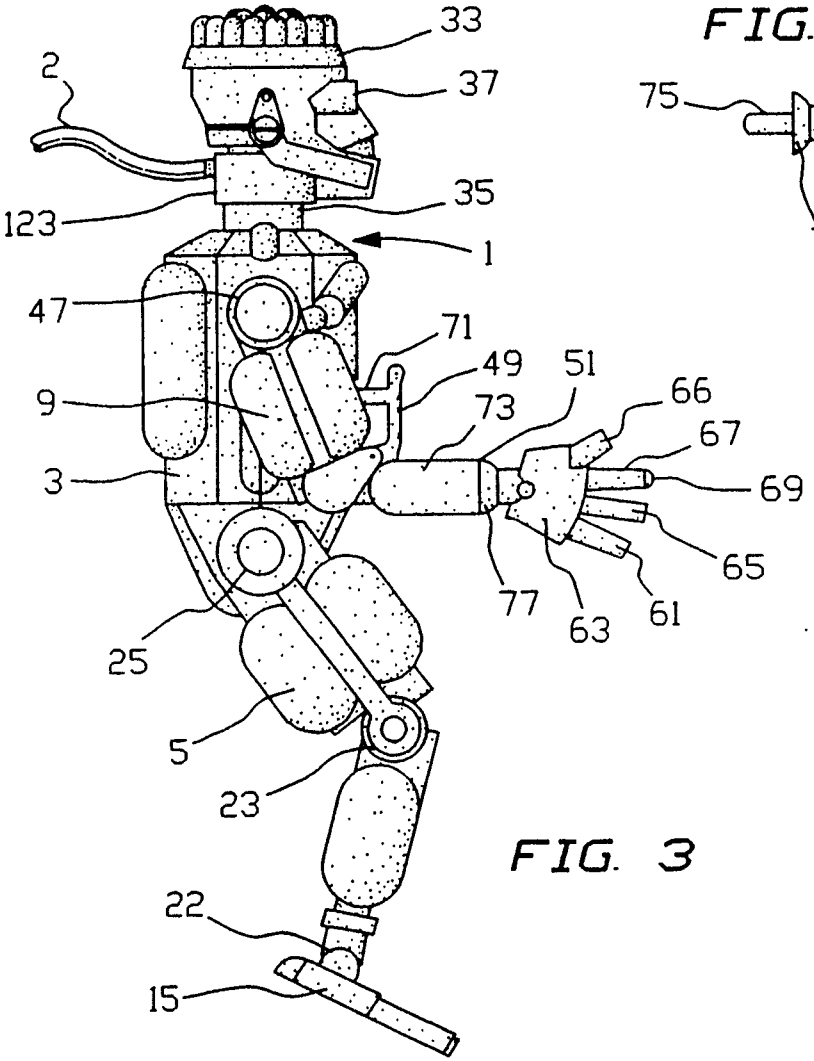
FIG. 3 shows the side view of the FIG. 1 action figure but with a hand replacing a weapon on one appendage.

Referring now to FIGS. 1, 2 and 3, FIG. 3 shows a side view of the action FIG. 1 of FIG. 1 but with weapon 41 removed and replaced by hand 63. Like parts are all like numbered. As seen in this view, appendage motion (arm 9, leg 5 and foot 15) is more vivid. Also, note that water release means 49 extends outwardly from forearm 73. It is kept biased via spring 71 and, in this position, pinches a tube (avenue of release) within the arm 9, as discussed with FIG. 6 below. If desired, the spring could be located internally within the arm 9 and can be in form of leaf spring or other spring type mechanism. Likewise, the water release means may be located elsewhere, without exceeding the scope of the invention.

Figure 4:
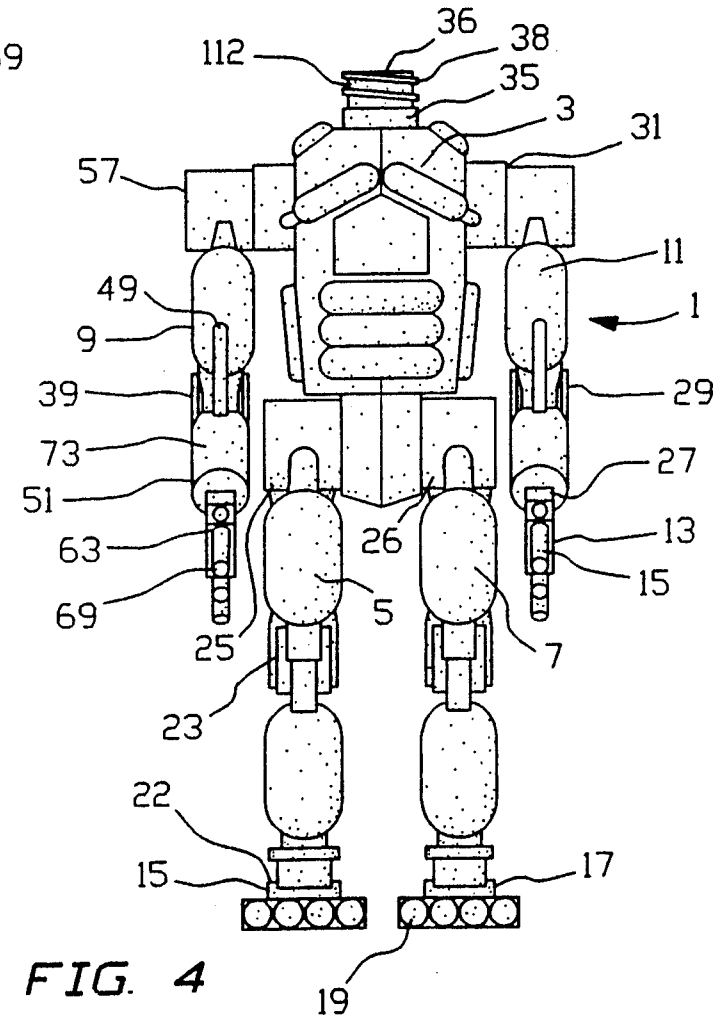
FIG. 4 shows the front view of the preferred embodiment expressed by FIG. 3, but with the head and the pumping and pressurizing means removed.

FIG. 4 shows a front view of the action FIG. 1 of FIG. 1 to illustrate more details of the arms 9 and 11 and legs 5 and 7. Like parts are all like numbered. Here, head 33 has been removed to show pressure reservoir orifice 36 with collar 112 and threads 38, and body collar 35. These threads allow for easy assembly, but one the neck 35 is attached, it may or may not be removable. Thus, it might be attached with glue or heat seal. Alternatively, collar 112 could have a snap fit or a force fit instead of threading.

In those instances were threads 38 are used instead of a permanent attachment means, i.e. when head 33 and the attached pumping and pressurizing mechanism is removable, the present invention action figure may be used without the remote water source and the opening for the remote water source connection, i.e. the remote water source inlet, may be used only as an air inlet. In such cases, the head would be removed so as to fill the pressure reservoir directly and, with the head screwed back on, the subsequent pumping would pull air through the remote water source inlet for pressurizing the reservoir. In other words, when the head is removable, the action figure of the present invention may be used with or without a remote water source and with or without a remote water source connecting tube.

Figure 5:
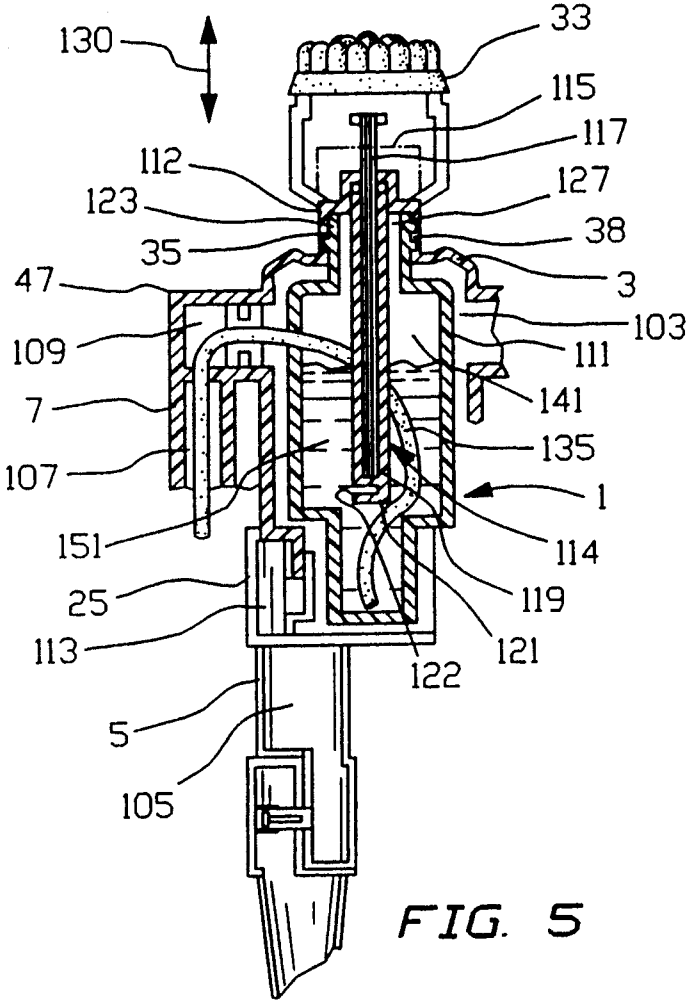
FIG. 5 shows a selective front cut view of a portion of the action figure preferred embodiment of the present invention shown in FIG. 1, with sections removed to better show interior mechanisms.

FIG. 5 shows a partial cut front view of action FIG. 1 of FIGS. 1, 3 and 4 with identical parts identically numbered. Referring to FIGS. 4 and 5, body 3 of action FIG. 1 is at least partially hollow. Likewise, appendages such as leg 5 and arm 9 and elements such as elements 25 and 27 have hollow areas 105, 107, 109 and 113, as shown. Within hollow portion 103 is pressure storage reservoir 111, which has an orifice 127 at its top, and is constructed to withstand high pressures, e.g. about 80 to about 100 pounds per square inch. As can be seen, it is structured to fit snugly within hollow 103 and thus obtains additional structural support. Neck 35 appears in earlier FIGS. 1, 3 and 4 and it is a collar through which reservoir collar 112 extends with its threads 38.

Pumping and Pressurizing means 114 includes air pump cylinder 119, pump rod 117 and piston 121 and threaded collar 123. Threaded collar 123 screws snaps or otherwise fits onto threaded reservoir collar 112. Remote water source connection tubing 2 connects to pumping and pressuring means 114 at the top thereof through collar 123 above its threaded portions. Pump rod 117 extends beyond collar 123 and acts as a slider. Head 33 is attached to pump rod 117 and acts as a slider handle. There is an O-ring in collar 123 and around pump rod 117, which provides a seal. As shown by arrow 130, head 33 may be moved or pumped up and down while collar 123 and tubing 2 are fastened permanently or removably onto collar 112. One way valve 122, e.g. an O-ring sealing on downstroke and open on upstroke, 122 pumps water from remote water source 4 into reservoir 111 and pressurized the air. Hence, pumping provides water to reservoir 111 and increases the air pressure within reservoir 111 to permit subsequent release of water therefrom.

Figure 6:
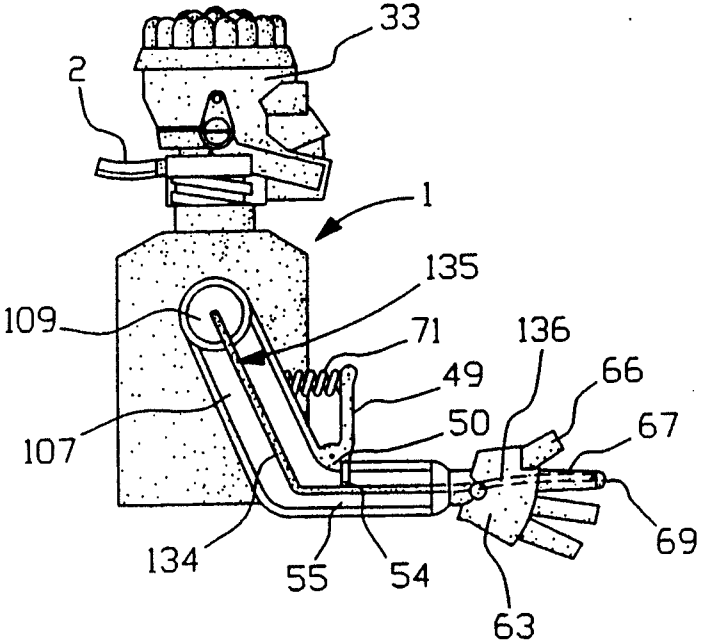
FIG. 6 illustrates a partially cut partial side view of the action figure of the present invention shown in FIG. 3, to illustrate a water release mechanism.

FIG. 6 shows a partial side cut view of the action FIG. 1 of FIG. 5 with like parts like numbered. This Figure illustrates the exit end of avenue of release 135 through hollow areas 109 and 107. Spring 71 biases water release means 49 pressed against and shutting off a flexible portion of avenue of release 135, as it is rotatably mounted with pin 50. As discussed in conjunction with FIG. 2 above, there is a portion of an avenue of release 136, which extends through finger 67 of hand 63 to nozzle 69.

The water storage reservoir 111 has an orifice 127 with a threaded collar 112 which is removably sealed to pumping and pumping and pressurizing means collar 123. The collar 123 forms a selective watertight and airtight seal by means of an O-ring between the reservoir 111 and the pumping and pressurizing means 114. Thus the water reservoir 111 and the pressurizing means 114 may be sealed from the ambient environment, the only air passing between these components through valve means 122 described below.

To fill the water reservoir 111 with water 151, the pumping and pressurizing means 114 is pumped to move water from remote source 4, into tubing 2, into cylinder 119 and then into the reservoir 111.

As it is being filled with water 151, the action FIG. 1 is being pressurized as water entering storage reservoir 111 compresses the air in space 141 above the water 151. Thus, the water from remote water source 2 is forced into reservoir 111 by the relative movement of the piston 121 within the air pump cylinder 119. The piston 121 is operated by the pump rod 117 that is connected to the piston 121 at one end and to the head 33, which acts as a slider handle, at the other end. The pump rod 117 is anchored to the slider handle head 33 and head 33 has a hollow 115 so as to maximize the stroke. Head 33 acting as a slider handle is operated manually by the user of the action FIG. 1. A user holds the head 33 with one hand and the action FIG. 1 with the other. The head 33 is then stroked or moved back and forth, i.e. pumped its full distance. The back and forth action is transferred to the piston 121, which forces water or air from the remote source through a one way valve 122 the pump or through a one way valving ring around piston 121 (not shown) which would permit air and/or water (below the piston) into cylinder 119 but not out of cylinder 119 (above the piston). It then flows past a one way flow valve 122, and into the water storage reservoir 111. Water (and sometimes move air) from the remote source is continuously added to the water storage reservoir 111 until a desired pressure is reached.

Once under pressure, the water 151 is selectively prevented from flowing freely through the conduit or avenue of release 135, comprising first section 134 and second section 136, by a water release means 49. A preferred release means as shown in this embodiment includes a spring biased pinch bar end 54 that clamps the avenue of release 135, i.e. outlet tubing, against a stop 55 that is part of the arm 7. Preferably, all of the tubing may be flexible tubing or, at least a portion is flexible when a pinch bar is used as the water release means. The pinch bar end 54 is biased against the stop 55 by a calibrated spring 71. The spring is held at one end by a formation of the arm 9 and pushes outwardly on release means 49. The strength of the spring 71 in its biased configuration is calibrated, so that when the pressure on the water 151 within the outlet tubing 135 reaches a predetermined maximum value, the spring 71 will allow the pinch bar end 54 to rise and water 151 will be released until safe pressure is maintained. Thus, the predetermined maximum value for the yielding of the spring 71 or other release means may preferably be between about 50 pounds per square inch and about 90 pounds per square inch. Other predetermined pressures of higher or lower value, e.g. at least about 100 pounds per square inch, may be used depending upon the particular components and specific configuration of a particular embodiment.

Other than the automatic water release for an overly high pressure, water 151 is released in the following manner. Rearwardly directed force is applied to the water release means 49, and is transferred to the pinch bar end 54 via the levered configuration that rotates around pivot pin 50. The transferred force applied to the pinch bar end 54 acts in opposition to the biasing force of spring 71. When the force of the release means 49 overcomes the force of the spring 71 the pinch bar end 54 is lifted from the outlet tubing 135 and water 151 is allowed to pass through the outlet tubing 135 and 136 terminating at a nozzle 69 (which has a narrow opening). Water 151 streams out of the narrow opening of nozzle 69 until either the force on the water release means 49 is released or until the air pressure within the water reservoir 111 reaches ambient. This may be in one long continuous stream or a series of bursts of water.

Figure 7:
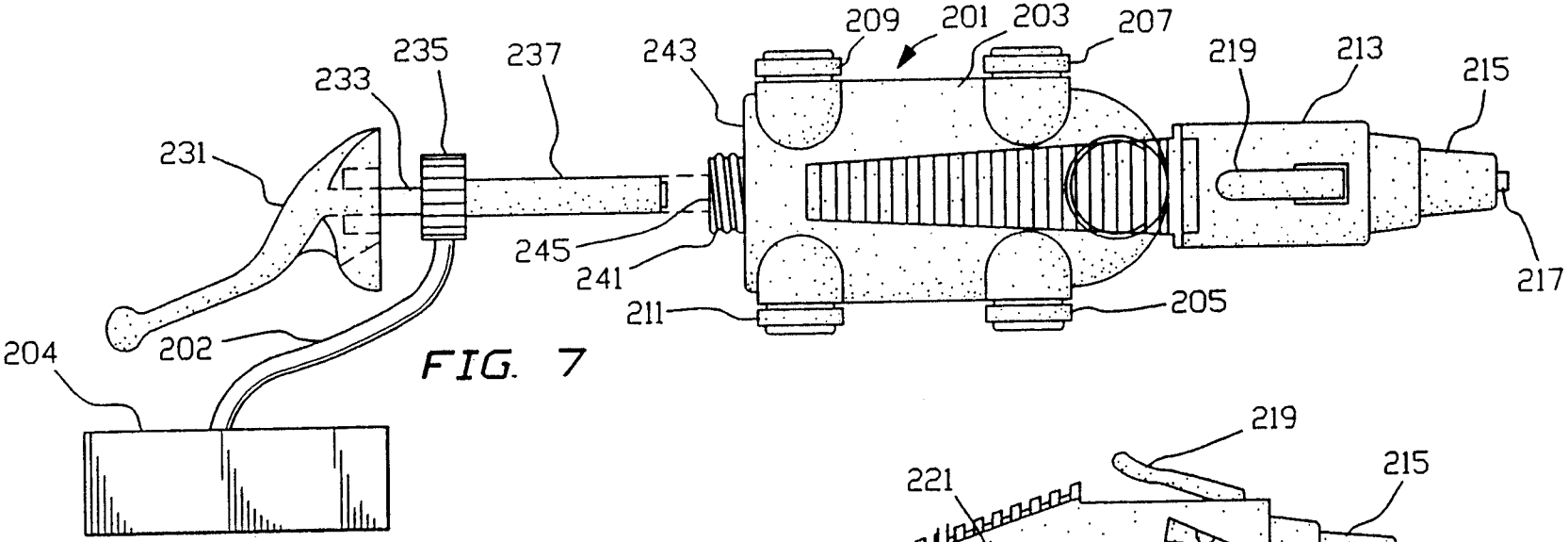
FIGS. 7 and 8 illustrate top and side views of an alternative embodiment of the present invention animal character action figure with the ability to shoot water.
Figure 8:
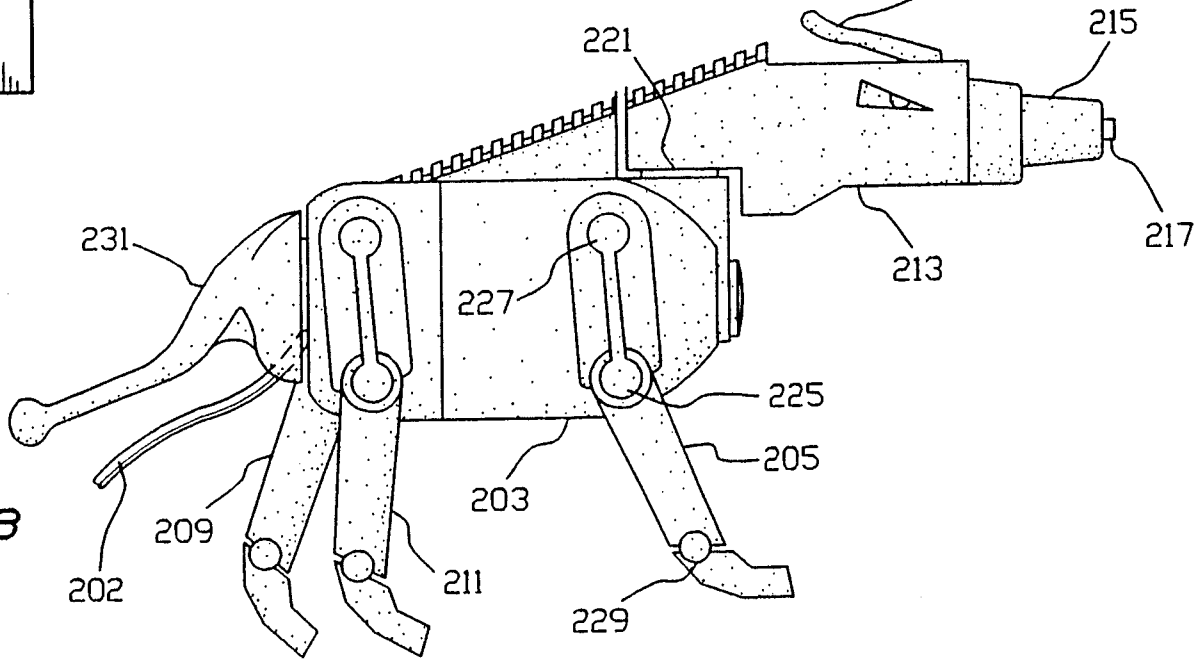

FIGS. 7 and 8 show a top view and a side view of an alternative embodiment action figure water gun of the present invention. Referring both to FIGS. 7 and 8 there is shown a present invention action FIG. 201 having a main body 203, legs 205, 207, 209 and 211. Head 213 includes a nose 215 with a nozzle 217 extending therefrom. Horn 219 is located on the top of head 213 and acts as a pressure release means. Head 213 is connected to main body 203 at rotatable neck 221. The appendages such as leg 205 includes multiple rotational members such as members 225, 227 and 229. All four of the legs have such members and these permit action figure 201 to have various positions, including bending, walking, standing, etc. Contained within main housing 203 is a water and air storage reservoir (not shown) which is similar to reservoir 111 shown is FIG. 5. Likewise, a pumping and pressurizing means is contained within cylinder 237 similar to pressurizing means 114 shown in FIG. 1, which would include a pump cylinder, (not shown) a piston (not shown) and pump rod 233. Cap 235 has threading on its inside and may be screwed onto threaded neck 241 located in the rear 243 of main body 203. Threaded neck 241 has an orifice 235 which connects directly to the water and air storage reservoir contained therein. Tail 231 acts similarly to head 33 of FIG. 5 in that it acts as a pump handle. Remote water source 202 is attached to the pumping an pressurizing means via tubing 204. Appropriate one way valves similar to those discussed in conjunction with FIG. 5 are likewise included, and operation is similar.

A user fills up the remote water source (if necessary) and pumps the tail back and forth so as to move pump rod 233 within the pump cylinder contained therein so as to pump water therein and to pressurize the storage reservoir. There is an avenue of release from the reservoir to nozzle 217 and there is also a water release means 219, with a spring bias (not shown) which opens the avenue of release to the flow of water from the reservoir when release means (horn) 219 is depressed by the user. When action figure water gun 201 is properly filled with water and pressurized air, depression of release means horn 219 permits water to be released via nozzle 217. This may be in short spurts, or for a very long sequence due to the pressurization within the storage reservoir.

Figure 9:
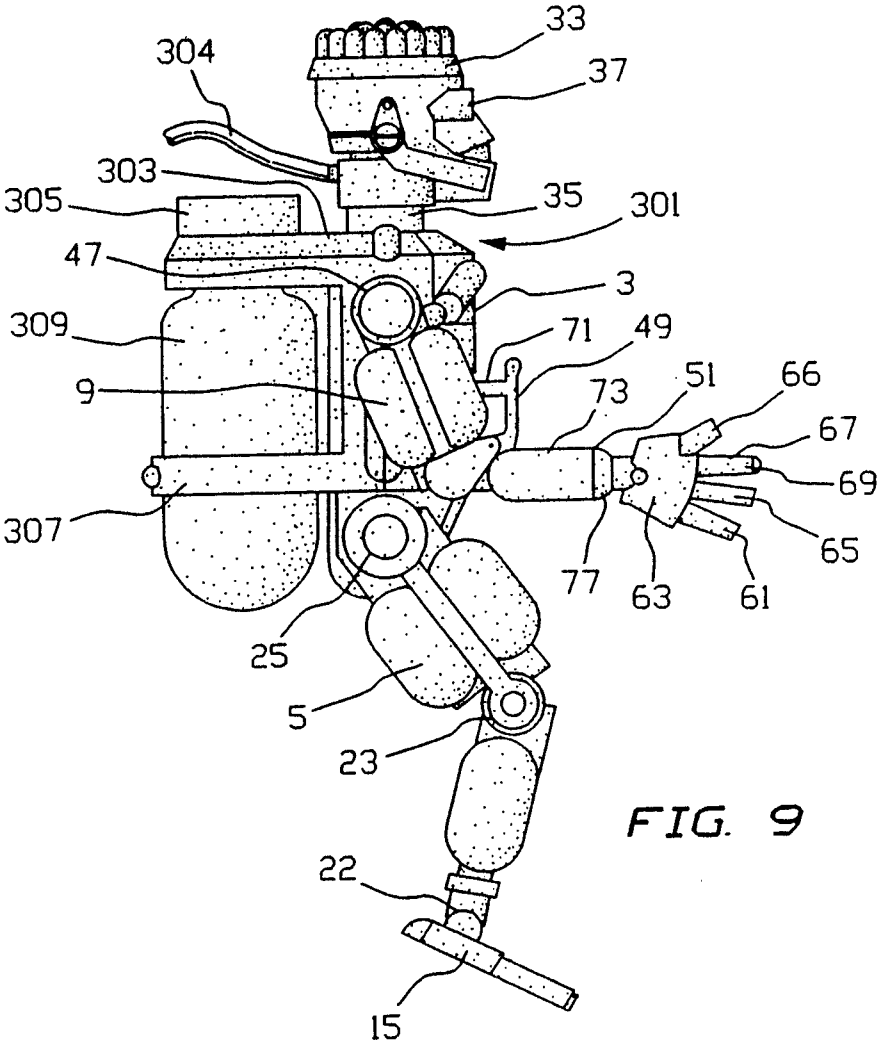
FIG. 9 shows a side view of a present invention action figure with an external, removable reservoir; and, FIG. 10 illustrates a cut front view of a present invention action figure preferred pumping and pressurizing means.

FIG. 9 shows a side view of an action FIG. 301 which is similar to the action figure shown in FIGS. 1 through 6. However, here, the water and air storage reservoir 309 is located externally from main body 3. Further, all parts identical to those shown such as in FIG. 3 are identically numbered here. Note that there is an extension 303 off of main body 3 which has an internally threaded section 305 for receiving reservoir 309. Brace 307 likewise extends from main body 3 to secure reservoir 309. Reservoir 309 is filled with via pumping head 33, as in the case of FIGS. 1 through 6 above. This is very much like that shown is FIG. 5 except that the pumping and pressurizing means is not contained within the reservoir but is contained within main body 3. Here, the one way valve at the bottom of the pump cylinder would not open directly into the water and air storage reservoir but would have tubing or a line connecting from the main body into extension 303 and down into reservoir 309. Likewise, tubing 304 would connect from a remote water source (not shown) to the pumping means as in FIG. 5.

Figure 10:
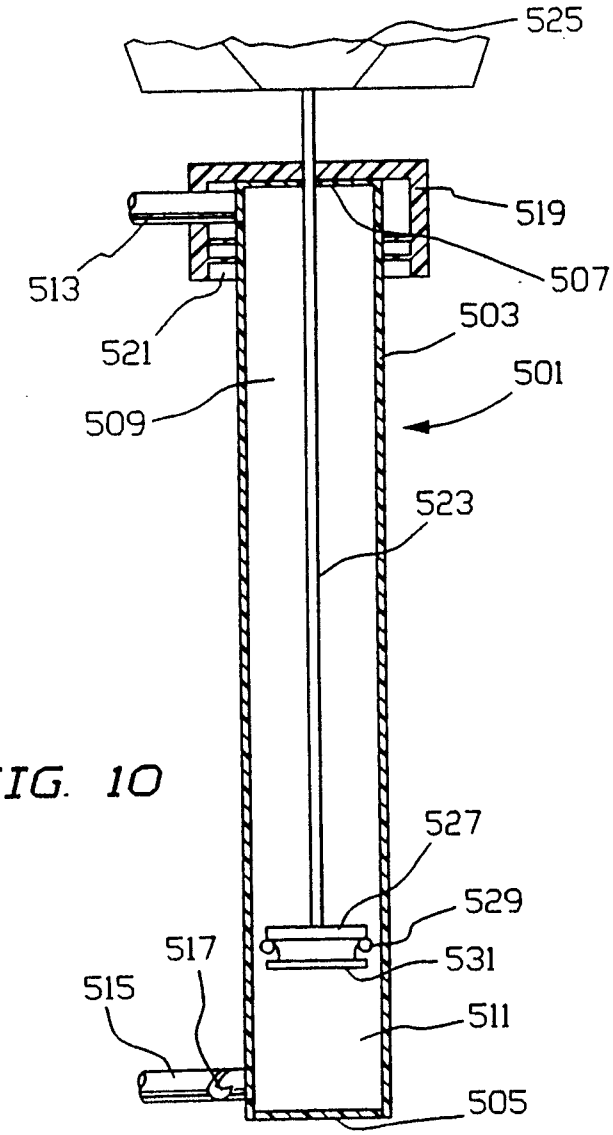

Referring to FIG. 10, there is shown a side cut view of a pumping and pressurizing means 501 of the present invention. Here, a cylinder and piston arrangement is shown and is similar to those discussed in conjunction with the earlier Figures above. Cylinder 503 includes a base 505 and a top section 507 through which piston rod 53 movably passes through. Inlet tubing 513 comes from a remote water source (not shown) and passes through an opening in cap 519 with attachment means 521 for subsequent attachment for the body of a present invention action figure. Outlet tubing 515 includes one way valve 517 so that water and/or air exits from the bottom space 511 of cylinder 503 but can not reenter cylinder 503 due to one way flap valve 517. Piston 527 includes O-ring 529 as well as a criss-cross base 531. Thus, when head 525 is pushed down on rod 523 and moved piston 527 downwardly, 0-ring 521 acts as a one-way valve and seals the space 511 below it so as to put position pressure on air and/or water in that space to move the air/and water through tubing 515 and in to the reservoir. When head 525 is pulled upwardly, piston 527 moves upwardly and 0-ring 529 drops down to criss-cross 531 so that the vacuum created in space 511 pulls water and/or air in space 519 and tubing 513 and remote water source (not shown) downwardly to fill the void created by the increasing volume of space 511. Thus, on the upstroke, the space 511 below piston 527 is filled by pumping in by pumping inwardly to tubing 513, and, when head 525 is pushed downwardly, as piston 527 moves downwardly and the valving seals via the upward closure of O-ring 529, liquid and/or air in space 511 is pumped outwardly through tube 515.

Obviously, numerous modifications and variations of the present invention are possible in light of the above teachings. It is therefore understood that within the scope of the appended claims, the invention may be practiced otherwise than as specifically described herein.

What is claimed is:

1. An action figure with the ability to shoot water by means of an air pressurized water chamber, comprising:

(a) a body having a form, a hollow portion, at least one body orifice and at least one ambulatory appendage, the form of said body selected from the group of humanoid forms, robotic forms and animalian forms, each ambulatory appendage having a means for movement with respect to said body;

(b) a water and air pressure reservoir connected to said body and having at least one orifice;

(c) a pumping and pressuring means for pumping water from a remote water source and for pressuring said storage pressure reservoir with air, said means being attachable to at least said pressure storage reservoir and said body;

(d) a remote water supply source inlet which is connected to said water and pressure reservoir via said pumping and pressurizing means said remote water supply source inlet being capable of use for intake of air through said pumping and pressurizing means as well as alternatively for intake of water and/or air from a remote water supply source;

(e) an avenue of release for water displaced by pressurized air in said pressure reservoir, said avenue of release being located within and extending from said reservoir to a nozzle;

(f) said nozzle being disposed at one end of said avenue of release; and, (g) a water release means for regulating the fluid flow through said avenue of release and out of said nozzle.

2. The action figure of claim 1, wherein said storage reservoir is located within said body.

3. The action figure of claim 2, wherein airflow from said reservoir to said pumping and pressurizing means is prevented by a one way flow device within said pumping and pressurizing means.

4. The action figure of claim 2, wherein waterflow from said reservoir into said pumping and pressurizing means is prevented by a one way flow device.

5. The action figure of claim 2, wherein said nozzle has a narrow orifice therethrough with a cross-sectional area less than that of said avenue of release.

6. The action figure of claim 1, wherein said body has a threaded collar at an orifice thereto and said pumping and pressurizing means is screwably attached to said collar and extends into said reservoir located within said body.

7. The action figure of claim 6, wherein a portion of said pumping and pressurizing means extends outside of said body in the form of an appendage of said action figure.

8. The action figure of claim 7, wherein said pumping and pressurizing means is a hand operated pump with a slider and said appendage with said portion of said pumping and pressurizing means activity acts as both a portion of the character of said action figure and as a handle for said slider.

9. The action figure of claim 7, wherein said action figure is a character with various appendages including ambulatory appendages and said appendage with said portion of said pumping and pressurizing means is a head.

10. The action figure of claim 2, wherein said avenue of release extends out of said body and through an appendage of said action figure with said nozzle being located in that appendage at the end of said avenue of release.

11. The action figure of claim 1, which further includes:

(h) a remote water supply source connected to said remote water supply source inlet.

12. The action figure of claim 11, wherein said remote water supply source is a container remotely located outside of said body and is connected to said pumping and pressurizing means via a flexible conduit.

13. The action figure of claim 12, wherein said remote water supply source is removably attached to said action figure.

14. The action figure of claim 12, wherein airflow from said reservoir to said pumping and pressurizing means is prevented by a one way flow device.

15. The action figure of claim 11, wherein a portion of said pumping and pressurizing means extends outside of said body in the form of an appendage of said action figure.

16. The action figure of claim 11, wherein said pumping and pressurizing means is a hand operated pump with a slider and said appendage with said portion of said pressurizing means acts as both a portion of the character of said action figure and as a handle for said slider.

17. The action figure of claim 1, wherein said water release means is a spring biased pinch bar that clamps said avenue of release, thus selectively restricting waterflow therethrough, and said water release means has a portion extending outwardly from said action figure to permit manual operation thereof.

18. The action figure of claim 17, wherein said spring biased pinch bar has a spring bias which is calibrated to yield to pressure within said avenue of release, when said pressure within said avenue of release exceeds a predetermined maximum value.

19. The action figure of claim 18, wherein said maximum value for the yielding of said spring bias to said pressure within said avenue of release is between about 50 pounds per square inch and about 90 pounds per square inch.

20. The action figure of claim 1, wherein said avenue of release has a first section and a second section and said first section extends out of said body and through an appendage to an end of said appendage, and said action figure includes one or more removable accessories removably attachable to said appendage, and said second section of said avenue of release and said nozzle are located within said accessory, and said second section having a first end to align with said first section of said avenue of release when said accessory is attached to said appendage and a second end connected to said nozzle.

* * * * *